US009229463B2

(12) United States Patent
Chu et al.

(10) Patent No.: US 9,229,463 B2
(45) Date of Patent: Jan. 5, 2016

(54) VOLTAGE TRACKING CIRCUIT

(71) Applicant: NANYA TECHNOLOGY CORPORATION, Tao-Yuan Hsien (TW)

(72) Inventors: Wei Lu Chu, Shanghai (CN); Bin Liu, Boise, ID (US)

(73) Assignee: NANYA TECHNOLOGY CORPORATION, Tao-Yuan (TW)

( * ) Notice: Subject to any disclaimer, the term of this patent is extended or adjusted under 35 U.S.C. 154(b) by 492 days.

(21) Appl. No.: 13/886,146

(22) Filed: May 2, 2013

(65) Prior Publication Data

US 2014/0327307 A1 Nov. 6, 2014

(51) Int. Cl.
*G05F 1/563* (2006.01)
*G11C 5/14* (2006.01)

(52) U.S. Cl.
CPC ..... *G05F 1/563* (2013.01); *Y10T 307/406* (2015.04)

(58) Field of Classification Search
CPC ..... G11C 16/10; G11C 7/1051; G11C 1/56
See application file for complete search history.

(56) References Cited

U.S. PATENT DOCUMENTS

| | | | | |
|---|---|---|---|---|
| 6,252,806 | B1 * | 6/2001 | Ellis | G11C 5/146 365/185.18 |
| 7,570,039 | B1 | 8/2009 | Vu | |
| 7,988,833 | B2 * | 8/2011 | Krauss | C23C 14/54 204/192.12 |

FOREIGN PATENT DOCUMENTS

| | | | |
|---|---|---|---|
| CN | 1484367 | A | 3/2004 |
| CN | 102053644 | A | 5/2011 |
| CN | 102053646 | A | 5/2011 |

OTHER PUBLICATIONS

Office Action dated May 6, 2015 from the China counterpart application 201410163562.8.

Search Report dated May 6, 2015 from the China counterpart application 201410163562.8.

English abstract translation of the Office Action dated May 6, 2015 from the China counterpart application 201410163562.8.

Abstract Translation of CN1484367A, CN102053644A and CN102053646A.

* cited by examiner

*Primary Examiner* — Jared Fureman
*Assistant Examiner* — Rafael Pacheco
(74) *Attorney, Agent, or Firm* — WPAT, P.C.; Anthony King

(57) ABSTRACT

A voltage tracking circuit, which comprises a voltage generating device, a first operational amplifier, a first voltage generator, and a diode-connected device. The voltage generating device provides a fixed voltage. The first operational amplifier has a first input terminal that can receive the fixed voltage, a second input terminal that is coupled with a protected device model, and an output terminal. The first voltage generator connects to the output terminal of the first operational amplifier and to a voltage limiter that is coupled with devices under protection. The diode-connected device is in a feedback loop that connects the second input terminal of the first operational amplifier to the first voltage generator.

10 Claims, 5 Drawing Sheets

VOLTAGE TRACKING CIRCUIT

DESCRIPTION

1. Technical Field

The present invention relates to a voltage tracking circuit.

2. Background

Semiconductor devices with thin gate oxides have a reliability problem when their gate-to-source voltages are too high. Thus, a pass transistor is normally used as a voltage limiter to protect these semiconductor devices. However, the voltage limiter also introduces timing and performance concerns if its gate voltage is not sufficiently high. In order to minimize the concerns, a Vt-tracking voltage generator is applied to ensure that the voltage limiter can have a constant maximum voltage even if it is under the influence of PVT (process, voltage, and temperature) variations.

FIG. 1 shows a conventional $V_t$-tracking voltage generator 1. The $V_t$-tracking voltage generator 1 has an operational amplifier 11. The positive input terminal of the operational amplifier 11 connects to a reference voltage source ($V_{ref}$), and the output terminal of the operational amplifier 11 connects to the gate terminal of a transistor 12. The transistor 12 can be an PMOS transistor whose source terminal is configured for the application of a voltage and whose drain terminal connects to the gate terminal of a transistor $M_{track}$, the drain terminal of the transistor $M_{track}$, and the gate terminal of a transistor MPG. The source terminal of the transistor $M_{track}$ connects to one end of series-connected resistors (R1 and R2) and another end of the series-connected resistors (R1 and R2) connects to the ground. A negative feedback connects the negative input terminal of the operational amplifier 11 to a connection node of the series-connected resistors (R1 and R2). The voltage $V_{out}$ of the source terminal of the transistor MPG can be determined by the following equation:

$$V_{out} = V_{ref} \times \left(1 + \frac{R1}{R2}\right) + V_{gs} - V_t$$

where $V_{gs}$ is the voltage from the gate to the source of the transistor $M_{track}$ and $V_t$ is the threshold voltage of the transistor MPG.

If the voltage $V_{gs}$ is very close to the voltage $V_t$, the voltage $V_{out}$ is approximately equal to a safe voltage $V_{safe}$. Because the voltage $V_{gs}$ can be used to track of the $V_t$ of the transistor MPG, the voltage $V_{out}$ can be limited to no more than the safe voltage $V_{safe}$.

The Vt-tracking voltage generator 1 uses a diode-connected transistor $M_{track}$ to track the voltage $V_t$ of the transistor MPG of the same size. However, the current $I_{fb}$ flowing through (or from the drain to the source of) the transistor $M_{track}$ will not change in response to the current $I_{ds}$ flowing through the transistor MPG, and the variation of the current $I_{fb}$ (occurring due to PVT variations) may result in a significant difference between voltage $V_{gs}$ and voltage $V_t$, which may cause an unacceptable tracking error problem.

SUMMARY

One embodiment of the present invention provides a voltage tracking circuit, which comprises a voltage generating device, a first operational amplifier, a first voltage generator, and a diode-connected device. The voltage generating device is configured to provide a fixed voltage. The first operational amplifier comprises a first input terminal configured to receive the fixed voltage, a second input terminal coupled with a protected device model, and an output terminal. The first voltage generator is coupled with the output terminal of the first operational amplifier and a voltage limiter that is coupled with devices under protection. The diode-connected device is configured to connect the second input terminal of the first operational amplifier and the first voltage generator.

The foregoing has outlined rather broadly the features and technical advantages of the present invention in order that the detailed description of the invention that follows may be better understood. Additional features and advantages of the invention will be described hereinafter, and form the subject of the claims of the invention. It should be appreciated by those skilled in the art that the conception and specific embodiment disclosed may be readily utilized as a basis for modifying or designing other structures or processes for carrying out the same purposes as those of the present invention. It should also be realized by those skilled in the art that such equivalent constructions do not depart from the spirit and scope of the invention as set forth in the appended claims.

BRIEF DESCRIPTION OF THE DRAWINGS

The accompanying drawings, which are incorporated in and constitute a part of this specification, illustrate embodiments of the disclosure and, together with the description, serve to explain the principles of the invention.

DETAILED DESCRIPTION

Figure 1:
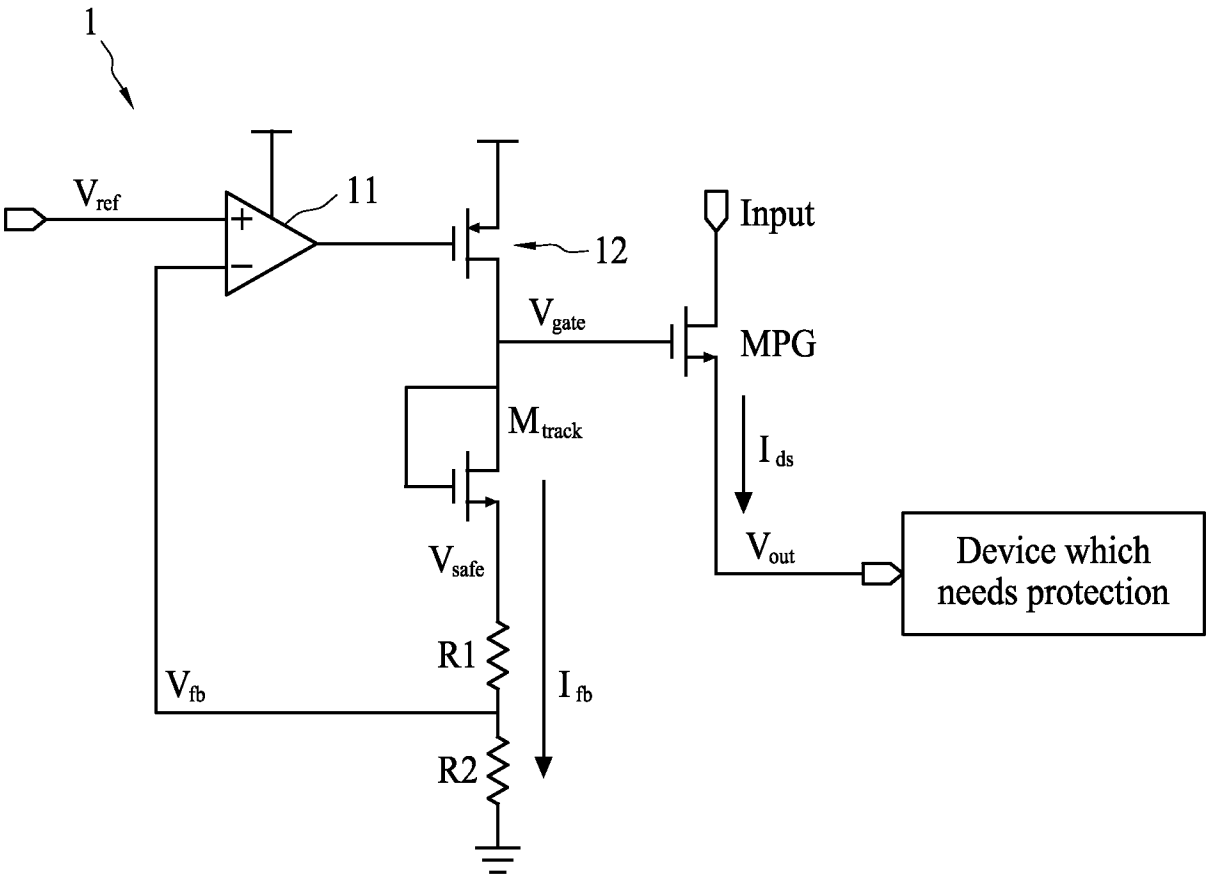
FIG. 1 (Prior Art)
FIG. 1 schematically shows a conventional $V_t$-tracking voltage generator.
Figure 2:
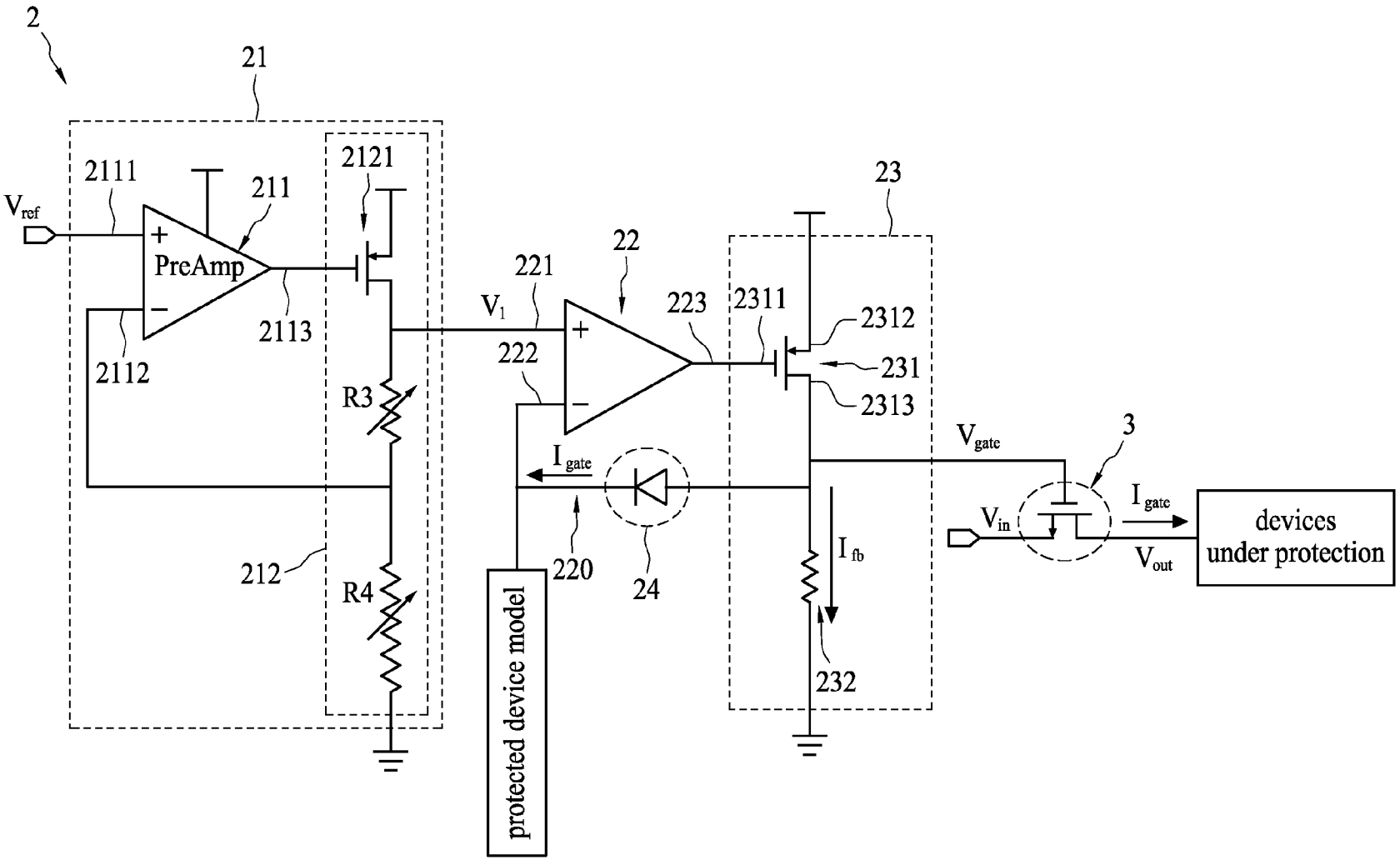
FIG. 2 schematically shows a voltage tracking circuit according to one embodiment of the present invention.

FIG. 2 schematically shows a voltage tracking circuit 2 according to one embodiment of the present invention. As shown in FIG. 2, the voltage tracking circuit 2 is configured to connect to a voltage limiter 3. The voltage tracking circuit 2 may comprise an operational amplifier 22, a voltage generator 23, and a diode-connected device 24. The diode-connected device 24 can have the same threshold voltage $V_t$ as the voltage limiter 3, and is placed in a feedback loop 220 of the operational amplifier 22 from the voltage generator 23 to one input terminal of the operational amplifier 22. The operational amplifier 22 is configured to receive a fixed voltage $V_1$ and provide a voltage to the voltage generator 23 such that the voltage generator 23 accordingly generates a voltage $V_{gate}$, which is approximately equal to the sum of the voltage $V_1$ and the threshold voltage of the voltage limiter 3.

In one embodiment, the voltage limiter 3 can be a transistor. In one embodiment, the voltage limiter 3 can be an NMOS transistor.

In one embodiment, the operational amplifier 22 comprises a first input terminal 221, a second terminal 222, and an output terminal 223. The fixed voltage $V_1$ is applied to the first input terminal 221. The feedback loop 220 connects the second terminal 222 to the voltage generator 23. The output terminal 223 connects to the voltage generator 23. In one embodiment, the first input terminal 221 is a positive input terminal, and the second terminal 222 is a negative input terminal.

As shown in FIG. 2, the voltage generator 23 is coupled with the voltage limiter 3 to provide the voltage limiter 3 with the voltage $V_{gate}$. The voltage generator 23 may comprise a transistor 231. The transistor 231 comprises a gate terminal 2311 that connects to the output terminal 223 of the operational amplifier 22; a terminal 2313 that can be the source or drain terminal and connect to the voltage limiter 3; and another terminal 2312 that connects to a power supply node. The feedback loop 220 of the operational amplifier 22 can connect the terminal 2313 of the transistor 231 to one input terminal of the operational amplifier 22, for example, the negative input terminal. In one embodiment, the transistor 231 is a PMOS transistor.

The voltage generator 23 may further comprise a resistor 232 that can connect the terminal 2313 of the transistor 231 to the ground, and a feedback current $I_{fb}$ flows through the resistor 232.

Referring to FIG. 2, the voltage tracking circuit 2 may comprise a voltage generating device 21 that is configured to provide the fixed voltage $V_1$ for the operational amplifier 22. In one embodiment, the voltage generating device 21 may comprise an operational amplifier 211 and a voltage generator 212, wherein one input terminal 2111 of the operational amplifier 211 connects to a reference voltage source $V_{ref}$, a feedback loop connects another input terminal 2112 of the operational amplifier 211 to the voltage generator 212, and the output terminal 2113 of the operational amplifier 211 connects to the voltage generator 212 to provide the fixed voltage $V_1$.

In one embodiment, the voltage generator 212 may comprise a transistor 2121 and two series-connected resistors (R3 and R4). The transistor 2121 and the two series-connected resistors (R3 and R4) are connected in series and are disposed between a power supply and the ground. The output terminal 2113 of the operational amplifier 211 connects to the gate terminal of the transistor 2121 and the input terminal 2112 of the operational amplifier 211 connects to a feedback loop that extends and connects to a connection node between the two series-connected first and second resistors (R3 and R4). One source or drain terminal of the transistor 2121 connects to a power supply node and another terminal of the transistor 2121 connects to the two series-connected first and second resistors (R3 and R4). In one embodiment, at least one of the first and second resistors (R3 and R4) is adjustable. In one embodiment, the transistor 2121 is a PMOS transistor.

As shown in FIG. 2, the voltage limiter 3 may connect to devices under protection. A protected device model can be applied to and connects to the second terminal 222 of the operational amplifier 22 to copy the current $I_{gate}$ flowing into the devices under protection so that the diode-connected device 24 can be used to track the threshold voltage $V_t$ of the voltage limiter 3. As such, the issue of the variation of the current $I_{fb}$ (occurring due to PVT variations) causing a difference between the voltage $V_{gs}$ of the diode-connected device 24 and the voltage $V_t$ can be avoided.

Figure 3:
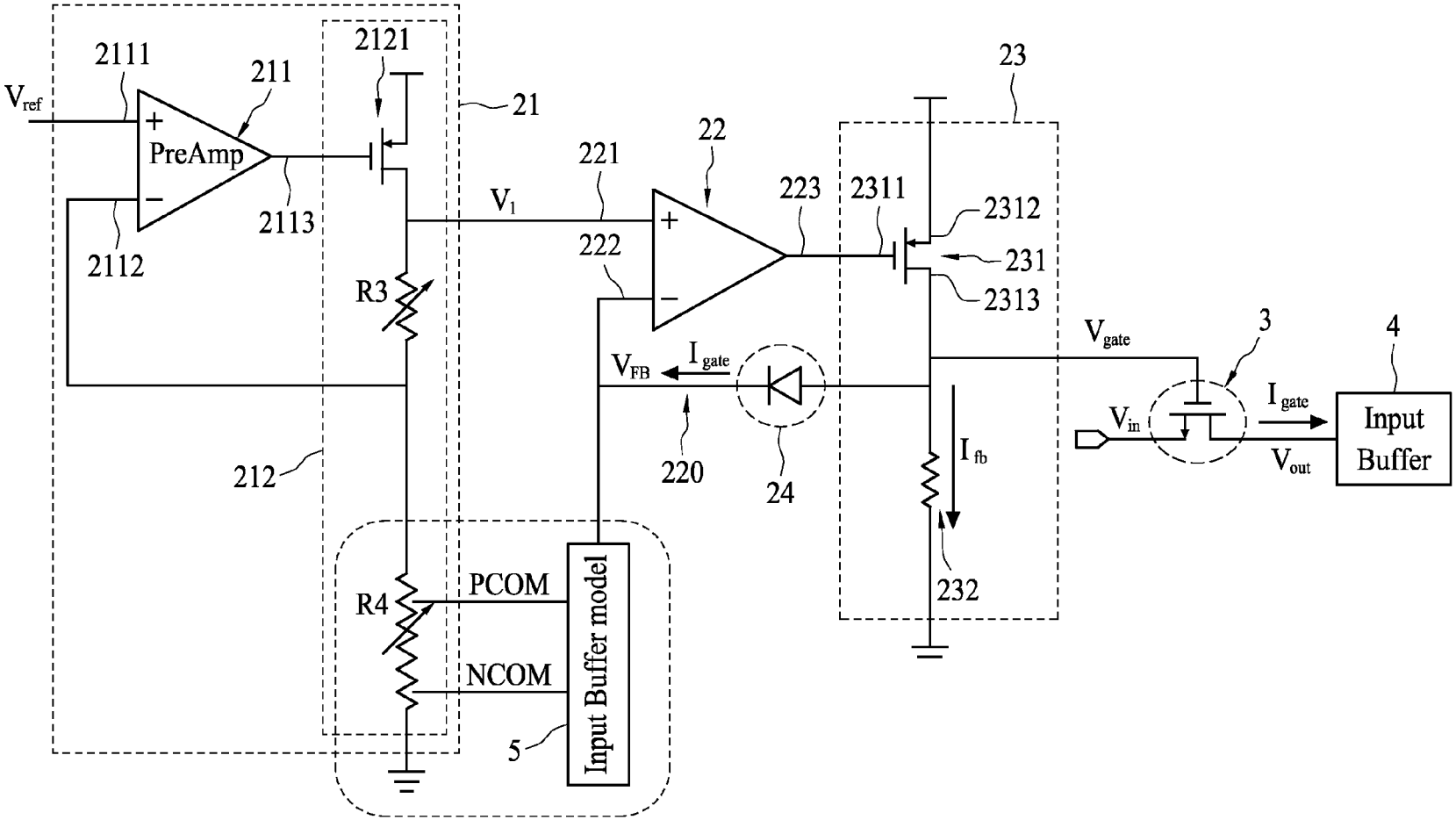
FIG. 3 schematically shows an application of a voltage tracking circuit according to one embodiment of the present invention.
Figure 4:
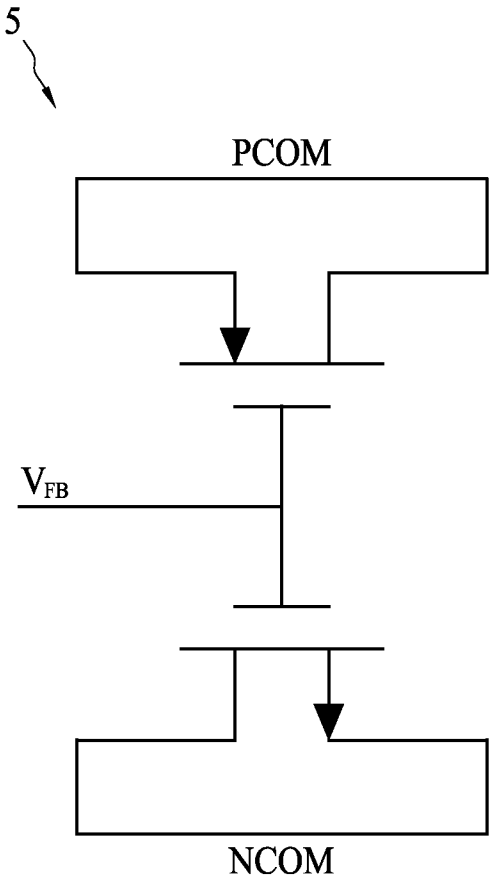
FIG. 4 schematically shows an input buffer model according to one embodiment of the present invention.

FIG. 3 schematically shows an application of a voltage tracking circuit 2 according to one embodiment of the present invention. FIG. 4 schematically shows an input buffer model 5 according to one embodiment of the present invention. As shown in FIGS. 3 and 4, the voltage tracking circuit 2 can be applied to an input buffer 4. In such an application, the voltage limiter 3 can connect to an input buffer 4, and the second terminal 222 of the operational amplifier 22 can connect to an input buffer model 5.

In one embodiment, the voltage $V_1$ or $V_{FB}$ may be 2 to 2.1 volts, and in order to ensure that NMOS devices in the input buffer 4 can operate safely, the NCOM, whose voltage level indicates the source DC voltage of an input NMOS pair inside the input buffer 4, is set to a voltage level of, for example, 1.05 volts from the operational amplifier 211 in order to cut down voltage $V_{gs}$ of the NMOS devices in the input buffer model 5.

In one embodiment, in order to have the same current $I_{gate}$ flowing to the input buffer model 5 as the gate current $I_{gate}$ flowing to input buffer 4, the NMOS devices in the input buffer model 5 are configured to have a size eighteen times larger than that of the NMOS devices in the input buffer 4 so as to compensate the cut down voltage $V_{gs}$ of the NMOS devices in the input buffer 4.

In one embodiment, the input buffer 4 comprises an input PLVT (low-$V_t$ PMOS) device, wherein the input PLVT device of the input buffer 4 has a size similar to that of the PLVT device of the input buffer model 5.

In one embodiment, the PCOM, whose voltage level indicates the source DC voltage of an input PMOS pair inside the input buffer 4 receive a voltage of 1.15 volts from the operational amplifier 211, and the NCOM receives a voltage of 1.05 from the operational amplifier 211.

Figure 5:
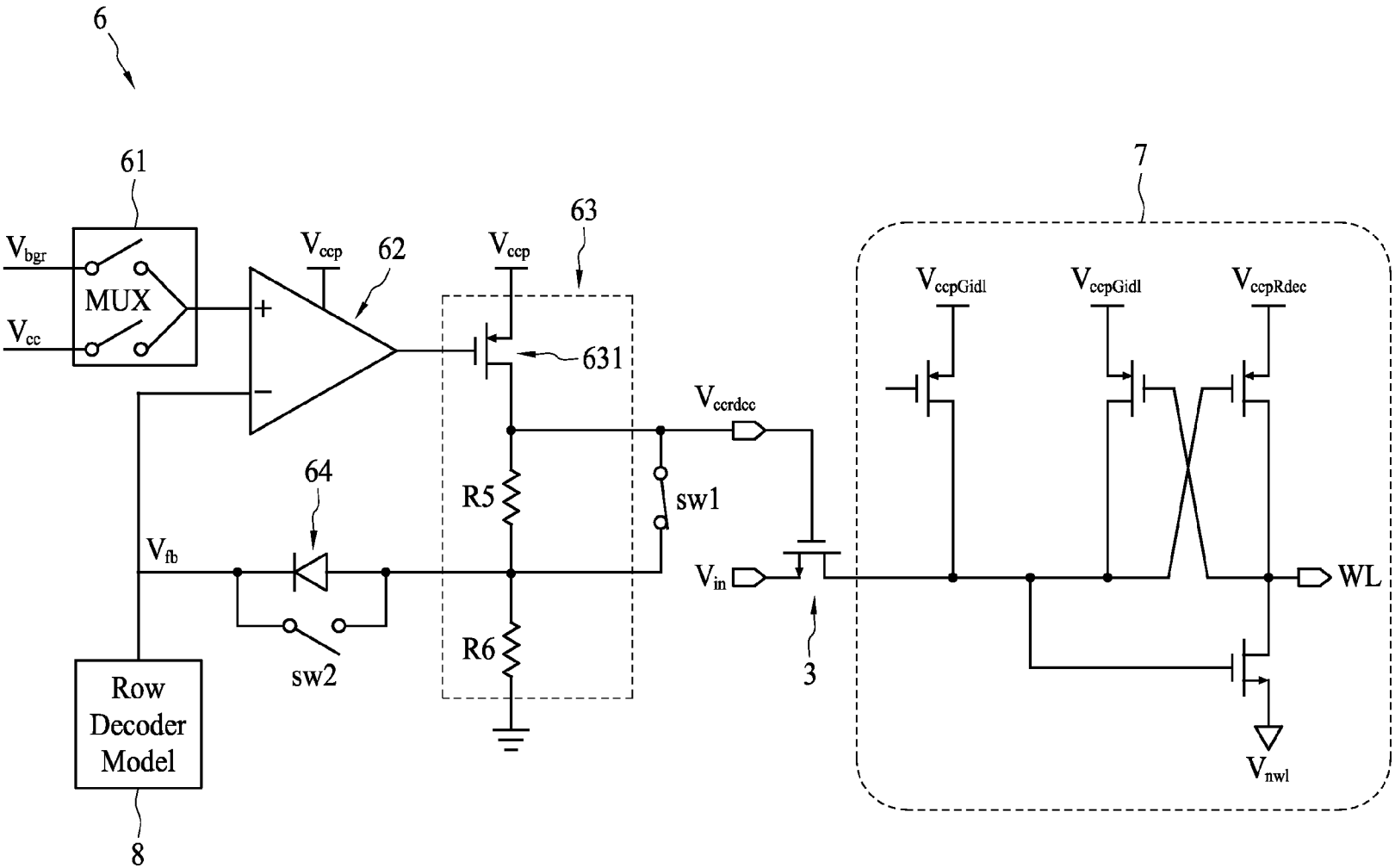
FIG. 5 schematically shows a voltage tracking circuit according to one embodiment of the present invention.

FIG. 5 schematically shows a voltage tracking circuit 6 according to one embodiment of the present invention. As shown in FIG. 5, the voltage tracking circuit 6 comprises a multiplex supply switch 61, an operational amplifier 62, a voltage generator 63, and a diode-connected device 64. The multiplex supply switch 61 connects to two power supplies $V_{bgr}$ and $V_{cc}$. The operational amplifier 62 has one input terminal connecting to the multiplex supply switch 61, another terminal connecting to a feedback loop that connects to the voltage generator 63, and the output terminal connecting to the voltage generator 63. The diode-connected device 64 is disposed in the feedback loop of the operational amplifier 62.

In one embodiment, the voltage generator 63 comprises a transistor 631 and two series-connected resistors (R5 and R6). The transistor 631 has a gate terminal connecting to the output terminal of the operational amplifier 62, a source terminal connecting to a power supply ($V_{ccp}$), and a drain terminal connecting to the two series-connected resistors (R5 and R6). The feedback loop of the operational amplifier 62 connects to a connection node between the two series-connected resistors (R5 and R6).

The drain terminal of the transistor 631 may connect to the gate terminal of the voltage limiter 3 whose source terminal connects to a power supply ($V_{in}$) and whose drain terminal connects to a WL (word line) driver or unit buffer 7, whose circuit is illustrated together with the power supply terminals ($V_{ccpGidl}$, $V_{ccpRdec}$, and $V_{nwl}$ (negative word line voltage)). Correspondingly, the negative input terminal of the operational amplifier 62 may connect to a row decoder model 8 so that the current $I_{gate}$ flowing into row driving devices can be copied and the diode-connected device 64 can be used to properly track the threshold voltage $V_t$ of the voltage limiter 3.

Referring to FIG. 5, the voltage tracking circuit 6 further comprises a switch sw1, wherein the switch sw1 and the resistor R5 are connected in parallel. The voltage tracking circuit 6 may further comprise another switch sw2, wherein the switch sw2 and the diode-connected device 64 are connected in parallel.

Referring to FIG. 5, when the switch sw1 is closed, the switch sw2 is open, and the multiplex supply switch 61 supplies a voltage $V_{bgr}$, the unit buffer 7 can receive a voltage ($V_{bgr}+V_t$), where the voltage $V_t$ is the threshold voltage of the voltage limiter 3. When the switch sw1 is closed, the switch sw2 is open; in which case, the multiplex supply switch 61 supplies a voltage $V_{cc}$ and the unit buffer 7 can receive a voltage ($V_{cc}$+$V_t$). When the switch sw1 is open and the switch sw2 is closed, the unit buffer 7 can receive a constant voltage ($V_{bgr}$ or $V_{cc}$)×(1+R5/R6).

Although the present invention and its advantages have been described in detail, it should be understood that various changes, substitutions and alterations can be made herein without departing from the spirit and scope of the invention as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein, may be utilized according to the present invention. Accordingly, the appended claims are intended to include within their scope such processes, machines, manufacture, compositions of matter, means, methods, or steps.

What is claimed is:

1. A voltage tracking circuit comprising:

a voltage generating device configured to provide a fixed voltage;

a first operational amplifier comprising a first input terminal configured to receive the fixed voltage, a second input terminal coupled with a protected device model, and an output terminal;

a first voltage generator coupled with the output terminal of the first operational amplifier and a voltage limiter that is coupled with devices under protection; and a diode-connected device disposed in a feedback loop connecting the second input terminal of the first operational amplifier and the first voltage generator.

2. The voltage tracking circuit of claim 1, wherein the first voltage generator comprises a first transistor that comprises a gate terminal coupled with the output terminal of the first operational amplifier and a first terminal coupled with the voltage limiter coupled with the devices under protection.

3. The voltage tracking circuit of claim 2, wherein the first voltage generator comprises two series-connected resistors connected with the first transistor in series.

4. The voltage tracking circuit of claim 3, wherein the voltage generating device comprises a multiplex supply switch.

5. The voltage tracking circuit of claim 4, further comprising a switch, which is arranged in parallel with one of the two series-connected resistors.

6. The voltage tracking circuit of claim 5, further comprising another switch, wherein the another switch and the diode-connected device are connected in parallel.

7. The voltage tracking circuit of claim 1, wherein the voltage generating device comprises:

a second operational amplifier comprising a first input terminal coupled with a reference voltage source, a second input terminal, and an output terminal; and a second voltage generator coupled with the second input terminal of the second operational amplifier and the output terminal of the second operational amplifier to generate the fixed voltage.

8. The voltage tracking circuit of claim 7, wherein the second voltage generator comprises a second transistor that comprises a gate terminal coupled with the output terminal of the second operational amplifier and a terminal coupled with the second input terminal of the second operational amplifier.

9. The voltage tracking circuit of claim 8, wherein the second voltage generator comprises two series-connected adjustable resistors.

10. The voltage tracking circuit of claim 1, wherein the first input terminal of the second transistor is a positive input terminal.

* * * * *